United States Patent [19]

Bertholdt et al.

[11] Patent Number: 4,942,594

[45] Date of Patent: Jul. 17, 1990

[54] METHOD FOR THE CHEMICAL DECONTAMINATION OF LARGE COMPONENTS AND SYSTEMS OF METALLIC MATERIALS OF NUCLEAR REACTORS

[75] Inventors: Horst-Otto Bertholdt, Erlangen; Bernhard Kress, Bubenreuth, both of Fed. Rep. of Germany

[73] Assignee: Siemens Aktiengesellschaft, Munich, Fed. Rep. of Germany

[21] Appl. No.: 788,781

[22] Filed: Oct. 18, 1985

[30] Foreign Application Priority Data

Oct. 31, 1984 [DE] Fed. Rep. of Germany ..... 3439857

[51] Int. Cl.[5] ..... G21F 9/00; C23G 1/00

[52] U.S. Cl. ..... 376/310; 252/626; 134/2; 210/760

[58] Field of Search ..... 252/626, 631; 422/186.08; 376/309, 310, 313; 134/2; 210/760

[56] References Cited

U.S. PATENT DOCUMENTS

| | | | |
|---|---|---|---|
| 4,162,229 | 7/1979 | Loewenschuss | 252/626 |
| 4,226,640 | 10/1980 | Bertholdt | 252/626 X |
| 4,284,428 | 8/1981 | Canning, Jr. | 134/2 X |
| 4,287,002 | 9/1981 | Torok . | |
| 4,481,090 | 11/1984 | Childs | 204/129.75 |
| 4,685,971 | 8/1987 | Murray et al. | 134/2 |

FOREIGN PATENT DOCUMENTS

| | | | |
|---|---|---|---|
| 134664 | 3/1985 | European Pat. Off. | 252/626 |
| 1517664 | 4/1971 | Fed. Rep. of Germany | 252/631 |
| 2613351 | 3/1976 | Fed. Rep. of Germany . | |
| 2714245 | 10/1977 | Fed. Rep. of Germany | 376/309 |
| 3013551 | 10/1980 | Fed. Rep. of Germany | 252/626 |
| 84/03170 | 8/1984 | PCT Int'l Appl. . | |

*Primary Examiner*—John S. Maples

*Attorney, Agent, or Firm*—Herbert L. Lerner; Laurence A. Greenberg

[57] ABSTRACT

Chemical decontamination of large components and systems of metallic materials of nuclear reactors with a liquid reactor coolant, wherein the treatment is carried out by means of an aqueous solution of oxidizing chemicals which is moved through the large components and systems to be decontaminated. Nitrates, chromates or Ce-IV salts are added as oxidizing chemicals in the particularly borate-containing primary coolant and also an addition of ozone is used.

18 Claims, 1 Drawing Sheet

METHOD FOR THE CHEMICAL DECONTAMINATION OF LARGE COMPONENTS AND SYSTEMS OF METALLIC MATERIALS OF NUCLEAR REACTORS

BACKGROUND OF THE INVENTION

1. Field of the Invention

The invention relates to a method for the chemical decontamination of large components and systems of metallic materials of nuclear reactors with a liquid reactor coolant, wherein the treatment is carried out by means of an aqueous solution of oxidizing chemicals which is moved through the large components and systems to be decontaminated.

2. Description of the Prior Art

German Published Non-Prosecuted Application (DE-OS) No. 26 13 351 and related U.S. Pat. No. 4,226,640 disclose a multistage method in which oxidative treatments and acid treatments are carried out alternatingly at temperatures of over 85° C. This continuous change of chemicals requires a relatively large amount of time and chemicals as well as of energy.

SUMMARY OF THE INVENTION

An object of the invention is to increase the effectiveness of the decontamination as well as reduce the production of secondary waste with one process step by the combination of chemicals. The treatment temperature is to be approximately ≦50° C.

With the foregoing and other objects in view, there is provided in accordance with the invention a method for the chemical decontamination of large components and systems of metallic materials of nuclear reactors with a liquid reactor coolant, which comprises: treating the metallic materials to effect decontamination by flowing an aqueous solution containing an oxidizing chemical through the large components and systems to be decontaminated, said oxidizing chemical selected from the group consisting of a nitrate, chromate or Ce-IV-salt, and introducing ozone into the aqueous solution flowing through the metallic material to be decontaminated. The aqueous solution is desirably kept at temperatures of 20° to 60° C. during the decontamination treatment.

Other features which are considered as characteristic for the invention are set forth in the appended claims.

Although the invention is illustrated and described herein as embodied in a method for the chemical decontamination of large components and systems of metallic materials of nuclear reactors, it is nevertheless not intended to be limited to the details shown, since various modifications may be made therein without departing from the spirit of the invention and within the scope and range of equivalents of the claims.

BRIEF DESCRIPTION OF THE DRAWING

The invention, however, together with additional objects and advantages thereof will be best understood from the following description when read in connection with the accompanying drawings in which.

DESCRIPTION OF THE PREFERRED EMBODIMENT

In accordance with the invention, the water content of a system or a component of nuclear reactors of metallic materials is enriched with ozone via a gas introduction system. The decontamination of the metallic materials takes place by a water (ozone) metal reaction controlled by means of oxidative additives. During the process, the dissolved active cations are removed by ion exchange resin.

Nitrates, chromates or Ce-IV salts are introduced as the oxidizing chemicals into the reactor coolant which contains in particular borate.

Thereby, the decontamination is carried out as a one-step treatment by means of an aqueous solution of oxidizing chemicals with the supplemental addition of ozone. The chemicals with oxidizing action, for instance, nitrates, chromates or cerium salts are inexpensive and lead to ions which can readily be removed with ion exchanger resins. In the process, the pH value is lowered during the decontamination by removal of the cations by means of ion exchangers. The range of concentrations of the oxidizing chemicals in milligrams per kilogram aqueous solution is preferably 100–1000 mg $kg^{-1}$, and of ozone, 10–'mg $kg^{-1}$. The effectiveness of the solution is monitored via the measurement of the oxidation-reduction or redox potential (rH).

The results of treating actual contaminate samples from a pressurized-water nuclear power station in a one-stage treatment according to the invention are shown in Table 1.

TABLE 1

| Oxidative Additives mg $kg^{-1}$ | Ozone mg $kg^{-1}$ | Dose Output $mrH^{-1}$ before | Dose Output $mrH^{-1}$ after |
|---|---|---|---|
| 1000 $NO_3$ | 10 | 5000 | 25 |
| 1000 $CrO_3$ | 10 | 4500 | 30 |

Material: DIN 1.4024 Chromium-Steel

Figure 1:
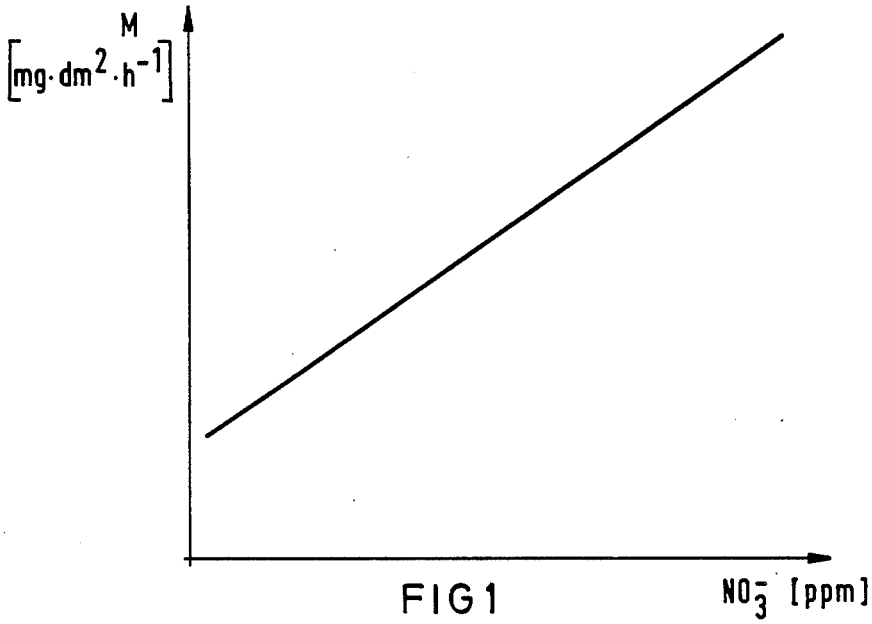
FIG. 1 shows the relationship of increasing concentration of $NO_3$ in an aqueous solution with increasing metal removed from a metallic material subjected to treatment by the aqueous solution, and FIG. 2 diagrammatically illustrates apparatus for carrying out the decontamination method in accordance with the invention.

With increasing operating time, the acid solubility decreases in the case of active protective oxide layers of the primary loop of a pressurized water reactor. By varying the combination of oxidative chemicals and ozone and by selective removal of cations, the method can be adjusted to the prevailing oxide prevention layer. The diagram shown in the attached drawing as FIG. 1 shows the relationship of metal removal a in terms of milligrams per square decimeter ($100cm^2$) per hour from the metallic materials treated with an aqueous solution containing the $NO_3$- parameter in terms of parts per million at increasing concentrations.

Since ozone dissolved in water has only a limited half-life value when in contact with oxidic surface layers, the ozone content is maintained at the desired concentration in the water by means of an external ozone enrichment section. Advantageously, at the same time, formation of gas cushions in the system to be decontaminated are prevented by continuous degasification.

Figure 2:
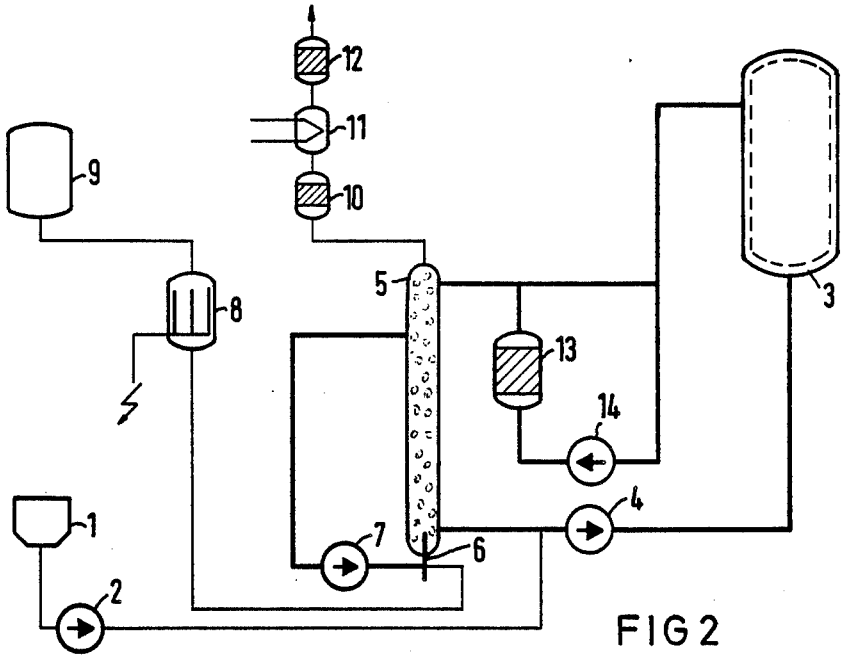

FIG. 2 of the attached drawing shows in simplified form a contaminated system with the corresponding auxiliary devices for decontamination according to the method of the invention. The method will be explained in greater detail with reference to this embodiment example:

The decontamination chemicals are fed from the preparation vessel 1 by a dosing pump 2 to the system 3 to be decontaminated, namely to the primary loop of a pressurized water reactor filled with borate-containing reactor cooling water, on the intake side of a pump 4. A partial stream of cooling water branched off from the system 3 to be decontaminated is transported via an ozone enrichment section 5 with an injector 6 and then flows to the intake side of pump 4 which returns it to system 3. This partial stream which flows via the enrichment section 5 is 10% or more of the cooling-water volume circulated to system 3 during the decontamination. The injector 6 is operated with a booster pump 7 to facilitate injection of the ozone and dispersion in the cooling water.

The fed-in ozone comes from an ozone generator 8 which is supplied with oxygen from the tank 9. This oxygen is converted by means of a silent electrical discharge partly into ozone. The ozone-containing gas is suctioned by the injector 6 into the enrichment section 5 which may be in the form of a bubble column. The material exchange between the gas and the liquid takes place in the injector 6 and in the following liquid column. The concentration of ozone in the solution is desirably analytically monitored continuously. This may be accomplished by continuously bleeding a small stream of solution from the main stream leaving the ozone enrichment section (not shown) and photometrically monitoring the small stream, after which the small stream may be returned to the main stream.

Excess oxygen present in the decontamination loop and the unabsorbed ozone are released from the upper end of the enrichment section 5 through an aerosol separator 10, and after being heated in a heating device 11, via a known catalytic ozone annihilation system 12 to the outside.

A second bypass with a pump 14 directs part of aqueous solution through the ion exchangers 13 wherein removal of the cations formed in the decontamination and during the dissolving activity takes place. The ion exchangers 13 are then disposed of by known measures, for instance, are dried and encapsulated with bitumen.

The foregoing is a description corresponding, in substance, to German application P 34 39 857.0, dated October 31, 1984, international priority of which is being claimed for the instant application and which is hereby made part of this application. Any material discrepancies between the foregoing specification and the specification of the aforementioned corresponding German application are to be resolved in favor of the latter.

There is claimed:

1. The method for the chemical decontamination of metallic elements of large components and systems of water-cooled nuclear reactors which essentially consists of only the single step of effecting the decontamination of the metallic material without addition of acids, by contacting the surfaces of said metallic materials by circulating through said systems an aqueous non-acidic solution essentially consisting of (a) at least one oxidizing chemical selected from the group consisting of chromataes, and cerium IV salts: (b) the water coolant for said reactor and (c) ozone.

2. Method according to claim 1, wherein the effectiveness of the decontamination solution is controlled by determining the redox potential of the solution.

3. Method according to claim 1, wherein the oxidizing chemicals are used in a concentration range of 100 to 1000 mg oxidizing chemicals per kg−aqueous solution.

4. Method according to claim 1 wherein the aqueous solution is kept at temperatures of 20 to 60° C. during the decontamination treatment.

5. Method according to claim 1, wherein the aqueous solution is borate-containing reactor cooling water in a primary loop of a pressurized-water reactor.

6. Method according to claim 5, wherein the ozone is continuously replenished into the reactor coolant via an ozone enrichment section.

7. Method according to claim 5, wherein the effectiveness of the decontamination solution is controlled by determining the redox potential of the solution.

8. Method according to claim 5 wherein ions having radioactivity dissolved in the reactor coolant are removed from the reactor coolant continuously by means of an ion exchange.

9. Method according to claim 8, wherein the pH value of the solution is lowered during the decontamination by removal of cations from the oxidizing chemicals.

10. Method according to claim 1, wherein the ozone is added to obtain a concentration range of 10–40 40 mg ozone per $kg^{-1}$ aqueous solution.

11. Method according to claim 10, wherein the concentration of the dissolved ozone is monitored continuously.

12. Method according to claim 11, wherein the continuous monitoring of a partial stream stripped out with air takes place photometrically.

13. Method according to claim 1, wherein the ozone is continuously replenished into the aqueous solution via an ozone enrichment section.

14. Method according to claim 13, wherein the ozone enrichment takes place by injecting the ozone into the aqueous solution by means of an injector together with a bubble column wherein the ozone and aqueous solution are admixed, wherein the admixture of ozone and aqueous solution is discharged from the lower end of the column, and wherein excess oxygen and unabsorbed ozone are released from the upper end of the column.

15. Method according to claim 14, wherein excess gas and unabsorbed ozone are removed upstream from the point of ozone enrichment, and wherein said removed ozone is subjected to ozone annihilation.

16. Method according to claim 15, wherein the ozone annihilation takes place catalytically.

17. The method for the chemical decontamination of large components and systems of metallic materials of nuclear reactors essentially consisting of: effecting decontamination of the metallic materials in only a single operational step, without addition of acids, by contacting said metallic materials with an acid-free aqueous solution containing (a) oxidizing chemicals consisting of chromates, (b) the liquid coolant and (c) ozone.

18. A method for the chemical decontamination of components, elements and systems of metallic materials of liquid-cooled nuclear reactors essentially consisting of only the single decontamination step of circulating through said system, thus contacting said contaminated metallic components with a non-acidic aqueous solution consisting essentially of all least one oxidizing chemical selected from the group of oxidizers consisting of chromate and cerium Iv salts, or mixtures thereof, the reactor coolant and ozone to loosen and remove any contaminants from said materials.

* * * * *